US011045848B2

(12) United States Patent
Froböse et al.

(10) Patent No.: US 11,045,848 B2
(45) Date of Patent: Jun. 29, 2021

(54) COLD-PILGER ROLLING MILL

(71) Applicant: Sandvik Materials Technology Deutschland GmbH, Düsseldorf (DE)

(72) Inventors: Thomas Froböse, Versmold (DE); Christofer Hedvall, Bielefeld (DE)

(73) Assignee: Sandvik Materials Technology Deutschland GmbH, Düsseldorf (DE)

( * ) Notice: Subject to any disclaimer, the term of this patent is extended or adjusted under 35 U.S.C. 154(b) by 230 days.

(21) Appl. No.: 16/064,493

(22) PCT Filed: Dec. 20, 2016

(86) PCT No.: PCT/EP2016/081913
§ 371 (c)(1),
(2) Date: Jun. 21, 2018

(87) PCT Pub. No.: WO2017/108784
PCT Pub. Date: Jun. 29, 2017

(65) Prior Publication Data

US 2019/0084020 A1 Mar. 21, 2019

(30) Foreign Application Priority Data

Dec. 23, 2015 (DE) ..... 10 2015 122 701.0

(51) Int. Cl.
*B21B 21/00* (2006.01)
*B21B 31/02* (2006.01)
*B21B 31/07* (2006.01)

(52) U.S. Cl.
CPC ..... *B21B 21/005* (2013.01); *B21B 31/028* (2013.01); *B21B 31/07* (2013.01)

(58) Field of Classification Search
CPC ..... B21B 21/005; B21B 21/04; B21B 21/045; B21B 31/028; B21B 31/10; B21B 31/103;
(Continued)

(56) References Cited

U.S. PATENT DOCUMENTS 2,387,515 A * 10/1945 Inslee ..... B21B 21/00 72/193
2,537,356 A * 1/1951 Larsson ..... B21B 21/005 72/214

(Continued)

FOREIGN PATENT DOCUMENTS

CN 87100390 A 9/1987
CN 2663041 Y 12/2004

(Continued)

OTHER PUBLICATIONS

Daniel Juchniewicz, "How to properly mount bearings", Oct. 15, 2014, Flow Control (Year: 2014).*

(Continued)

*Primary Examiner* — Adam J Eiseman
*Assistant Examiner* — Dylan Schommer
(74) *Attorney, Agent, or Firm* — Morgan, Lewis & Bockius LLP

(57) ABSTRACT

Pilger rolling mill for working a hollow into a tube has a first roll stand mounted linearly moveable in a direction of motion. Translational motion of the roll stand causes rotational motion of the drive gear due to the cogging of the drive gear with the gear rack and, hence, also rotational motion of the roller arranged on the shaft of the drive gear and rotational motion of the other one of the two rollers in the opposite direction. Roll stand is connected with a crank drive and rotational motion of a motor drive is transformed into an oscillating translational motion of the roll stand by a connecting rod. Gear rack holder allows adjustment of the pilger rolling mill with respect to tube diameters of finished rolled tubes by arranging the first roll stand exchangeable by a second roll stand with a second dimension being different from the first dimension.

20 Claims, 5 Drawing Sheets

Figure 1:
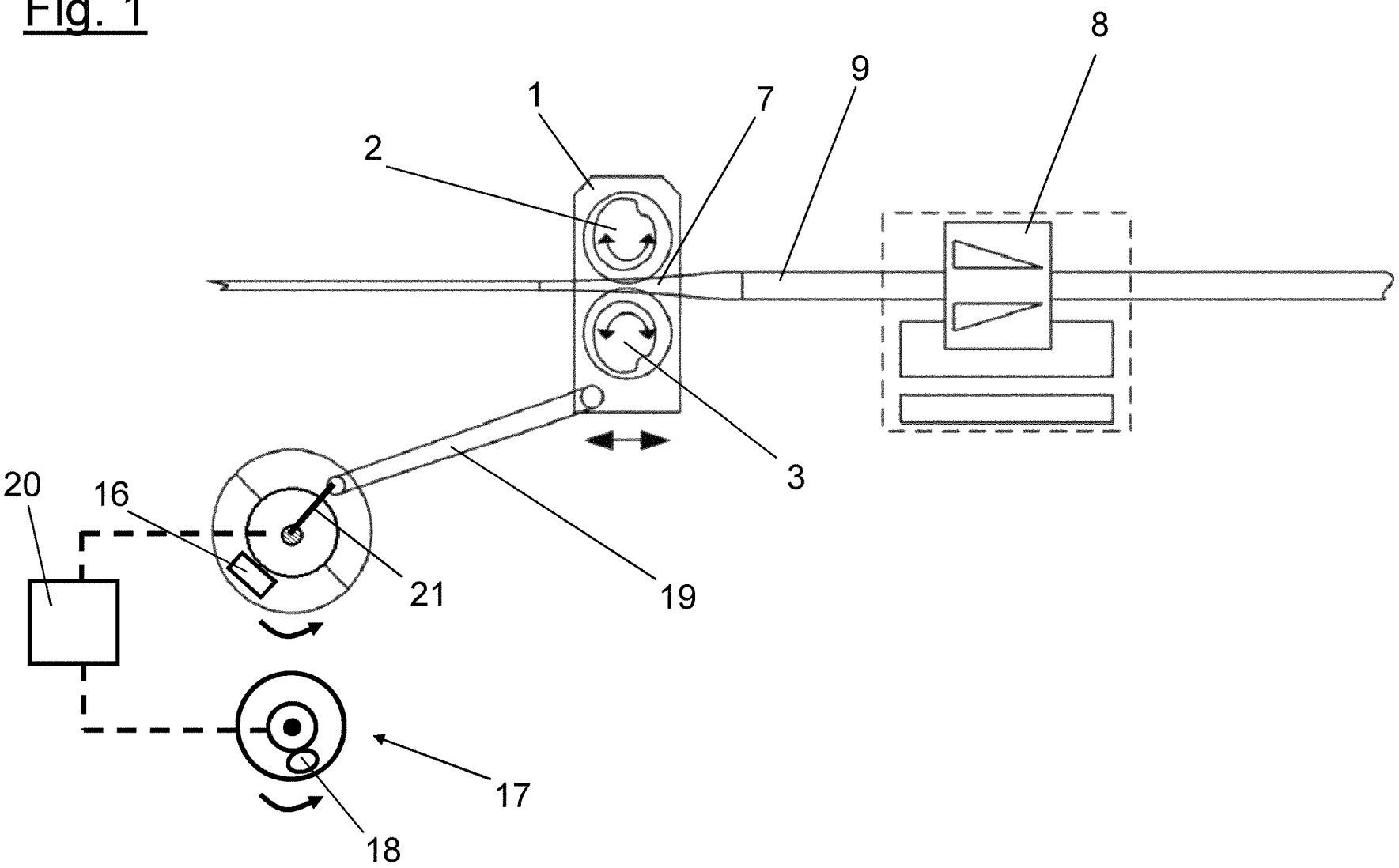

(58) Field of Classification Search
CPC ..... B21B 31/14; B21B 31/106; B21B 31/12; B21B 31/16; B21B 31/18; B21B 31/22; B21B 31/24; B21B 37/04; B21B 37/06; B21B 31/08; B21B 31/00; B21B 31/02; B21B 31/04; B21B 31/07; B21D 43/003
See application file for complete search history.

(56) References Cited

U.S. PATENT DOCUMENTS

| | | | | | |
|---|---|---|---|---|---|
| 2,738,682 | A | * | 3/1956 | Skardal | B21D 43/003 474/102 |
| 3,369,383 | A | * | 2/1968 | Barnikel | B21B 31/20 72/237 |
| 4,660,400 | A | | 4/1987 | Potapov et al. | |
| 4,763,505 | A | | 8/1988 | Klute et al. | |
| 4,993,251 | A | | 2/1991 | Szendre et al. | |
| 5,497,644 | A | * | 3/1996 | Poloni | B21B 13/001 72/239 |
| 9,539,627 | B2 | | 1/2017 | Frobose | |
| 9,796,007 | B2 | | 10/2017 | Frobose | |
| 2009/0113975 | A1 | * | 5/2009 | Eddens | B21B 21/02 72/214 |

FOREIGN PATENT DOCUMENTS

| | | | | | |
|---|---|---|---|---|---|
| DE | 6752062 | U | | 2/1969 | |
| DE | 102011052739 | A1 | * | 2/2013 | B21B 21/005 |
| DE | 102011052739 | A1 | | 2/2013 | |
| DE | 102012112398 | A1 | | 6/2014 | |
| DE | 102013112371 | A1 | | 5/2015 | |
| FR | 1502302 | A | | 11/1967 | |
| GB | 786675 | A | * | 11/1957 | B21B 21/005 |
| GB | 1261106 | A | * | 1/1972 | F16H 19/04 |
| GB | 1261106 | A | | 1/1972 | |
| JP | S58-029508 | A | | 2/1983 | |
| JP | 63084707 | A | * | 4/1988 | B21B 13/005 |
| JP | H03-207509 | A | | 9/1991 | |
| RU | 2086319 | C1 | | 8/1997 | |

OTHER PUBLICATIONS

International Search Report and Written Opinion dated Mar. 8, 2017 issued in corresponding International Patent Application No. PCT/EP2016/081913.
First Office Action issued in corresponding Chinese Patent Application No. 201680076154.6, dated May 15, 2019.
Office Action issued in corresponding Japanese Patent Application No. 2018-533657, dated Nov. 10, 2020.

* cited by examiner

COLD-PILGER ROLLING MILL

The present invention relates to a pilger rolling mill for working a hollow into a tube with a first roll stand mounted linearly movable in a direction of motion, wherein two rollers are pivotably mounted on shafts at the roll stand for working the hollow into the tube, wherein one of the rollers is arranged on the shaft together a drive gear and wherein the drive gear cogs with a gear rack which is fixed at a gear rack holder such that a translational motion of the roll stand causes a rotational motion of the drive gear at the roller, and with a crank drive connected to the roll stand, wherein the crank drive transforms a rotational motion of a drive motor into an oscillating translational motion via a connecting rod during operation of the pilger rolling mill.

For manufacturing precise metal tubes, in particular of steel, a hollow cylindrical blank is reduced by compressive stresses. In this process, the blank is worked into a tube with a defined reduced outer diameter and a defined wall thickness.

The most common reducing process for tubes is known as cold pilgering, wherein the blank is denoted a hollow. During rolling, the hollow is pushed over a calibrated mandrel, defining the inner diameter of the finished tube, and is gripped by two calibrated rollers from the outside, defining the outer diameter of the finished tube, and is rolled out in a longitudinal direction over the mandrel.

During cold pilgering, the hollow is fed stepwise in a direction towards the mandrel and over the mandrel, respectively, while the rotating rollers are moved back and forth horizontally over the mandrel and, therefore, over the hollow. In this process, the horizontal motion of the rollers is forced by the roll stand, at which the rollers are pivotably mounted. At known cold pilger rolling mills, the roll stand is moved back and forth in a direction parallel to the mandrel by using a crank drive.

In an embodiment, the crank drive is connected with a torque and mass balancing system, which stores the kinetic energy which is released at the reversal points of the back and forth motion of the roll stand, and which uses this energy for a subsequent acceleration of the roll stand after the reversal of the direction of motion. In contrast, the rollers are provided with a rotational motion by a gear rack relatively fixed with respect to the roll stand, wherein gear wheels rigidly connected with the roller axis cog with this gear rack.

The feed clamping carriage with the hollow is moved over the mandrel in the so-called feed direction. The conically calibrated rollers, which are arranged vertically one above the other in the roll stand, rotate with the same angular velocity in opposite directions with respect to each other while the feed clamping carriage holds the hollow. In this process, both rollers roll in the same direction parallel to the cylindrical axis of the hollow and opposite to the feed direction of the lateral surface of the hollow.

The caliber shape of the essentially circular, calibrated rollers diminishes steadily until the diameter of the finished tube is reached for the last cross section of the caliber. In general, the cross section of the caliber consists of a working caliber, which comprises a conical pilgrim jaw, a constant circular smoothing caliber and a subsequent, slightly increasing release, and of an idling caliber with a larger opening. The pilgrim jaw formed by the rollers grasps the hollow and the rollers push up a small wave of material from the outside. The wave of material is stretched by the smoothing caliber of the rollers and by the mandrel to the desired wall thickness, until the idling caliber of the roller releases the finished tube. During rolling, the roll stand, with the rollers mounted to it, moves into a direction opposite to the feed direction of the hollow. Using the feed clamping carriage, the hollow is pushed one step further into the direction towards the mandrel after the hollow reaches the idling caliber of the roller, while the rollers together with the roll stand return to their horizontal starting position. At the same time, the hollow is rotated around its own axis, in order to achieve a uniform shape of the finished tube also in the circumferential direction. By multiple rolling of each tube section, a uniform wall thickness and circularity of the tube as well as a uniform inner and outer diameter are achieved.

A pilger rolling mill of the prior art is constrained to the production of finished tubes with a small range of inner and outer diameters, since the roll stand, used in the respective pilger rolling mill, is always adjustable for a small range of inner and outer diameters of the tubes to be manufactured, only. In order to provide a large variety of inner and outer diameters of finished tubes to the respective market, a variety of pilger rolling mills with different roll stands has to be provided as well. In this regard, the roll stands have to be selected for the respective diameter requirements of the tubes to be processed.

For the manufacturing of finished tubes with larger diameters, also larger roll stands are needed with respect to the width of the roll stand and the diameter of the rollers used in the roll stand. With increasing size of the roll stand, also the mass of the roll stand increases.

A roll stand with a certain size is arranged for a particular diameter range of the finished tubes, within which range the hollow is processed as good as possible, i.e. as uniform as possible. Indeed, it is possible to roll the hollow outside of this parameter range, however, then the rollers work outside their optimal range. Hence, the precision of the manufacturing process decreases and the finished tubes have a worse quality when compared with finished tubes, which have been processed in the optimal parameter range.

According to the prior art, only one specific inner and outer diameter of a tube, which is processed in a pilger rolling mill, can be manufactured with a certain roll stand and a set of rollers attached to this roll stand. The value of the outer diameter of the finished tube can only be broadened in a very narrow range of values, by replacing the rollers of the roll stand with a second set of rollers. The rollers of the second set of rollers differ from the rollers of the first set of rollers with respect to their caliber shape. The caliber shape of the rollers of the second roll stand comprises a design in a peripheral direction different to the caliber shape of the rollers of the first roll stand, such that, due to this design, the hollow is grabbed by the pilgrim jaw of the second set of rollers with a slightly different diameter, is shaped in the smoothing caliber and is delivered to the idling caliber at the outlet for releasing the finished tube. Therefore, the outer diameter of the finished tube can be changed in a narrow range of values.

The expanded boundaries of the processable tube diameters are due to the circumstance, that the rollers of the second pair of rollers have to be installable in the roll stand of the pilger rolling mill. On the one hand, this requirement causes an adjustment of the extension of the rollers of the second roller pair parallel to the cylinder axis with respect to the width of the roll stand. On the other hand, this requirement implies that the diameter of the rollers of the second roller pair is identical to the diameter of the rollers of the first roller pair, such that the position of the rotational axis of the rollers remains unchanged.

However, a change of the rollers is time consuming and leads to longer downtimes of the pilger rolling mill as well as to higher costs.

In view of this background, it is an object of the present invention to provide a pilger rolling mill, which facilitates manufacturing of tubes in a range of inner and outer diameters in the same pilger rolling mill wherein this range enlarges the narrow value range of the prior art. Moreover, it is an object of the present invention to guarantee a larger flexibility with respect to the tube diameters to be processed in one and the same pilger rolling mill. A further object of the present invention is to facilitate shorter downtimes of the pilger rolling mill and to facilitate a faster exchange of the rollers of the pilger rolling mill.

At least one of these problems according to the present invention is solved by a pilger rolling mill for working a hollow into a tube with a first roll stand mounted linearly movable, wherein two rollers are pivotably mounted on a shaft at the roll stand for working the hollow into a tube, wherein one of the rollers is arranged on a shaft with a drive gear and wherein the drive gear cogs with a fixed gear rack, wherein the gear rack is mounted on a gear rack holder in such a way that a translational motion of the roll stand causes a rotational motion of the drive gear and the rollers, and with a crank drive connected to the roll stand, which transforms a rotational motion of a drive motor into an oscillating translational motion of the roll stand via a connecting rod during operation of the pilger rolling mill, wherein the gear rack holder is arranged in a way that the first roll stand with a first dimension is exchangeable by a second roll stand having a second dimension different from the first dimension.

The gear rack holder according to the invention enables to provide a pilger rolling mill, which is adaptable cost efficiently with respect to the tube diameters of the finished tubes to be manufactured, such that it is possible to manufacture tubes with different diameters in the same pilger rolling mill. Moreover, the finished tubes have an improved accuracy and precision due to the adaptation of the roll stand with respect to the tube diameter requirements of the finished rolled tubes.

In the sense of the present invention, the term dimension of a roll stand refers to the three spatial dimensions, namely length, width and height, and also refers to the dimensions of the rollers as well as the drive gear, particular with respect to their diameter In an embodiment of the present invention, the first roll stand comprises a mass different from the mass of the second roll stand.

In an embodiment of the present invention, the first and second roll stands have different widths (perpendicular to the direction of motion) and masses.

In an embodiment of the present invention, a material of the hollow is selected from a group of materials consisting of an unalloyed steel, a low alloyed steel and a high alloyed steel or a combination thereof. In a further embodiment, the hollow is made of stainless steel.

Further, the gear rack holder according to the invention enables to exchange the roll stand easily by a second roll stand, having different dimensions, without any noticeable loss in time. In contrast to the conventional processes for exchanging the rollers, the shut downs caused by the change of the roll stands can be reduced considerably and the productivity of the mill can be significantly increased.

In an embodiment of the present invention, the pilger rolling mill comprises a gear rack holder, which is formed in a manner that the gear rack is adapted to be arranged at the gear rack holder at least at two positions which are separated from each other in a direction parallel to the shafts of the rollers.

The gear rack holder according to the invention makes it possible that a drive gear of the roll stand can cog with the gear rack fixed at the gear rack holder at least at two positions separated from each other in a direction parallel to the shafts of the rollers. Hence, at least two roll stands with two different widths can be installed in the same pilger rolling mill, wherein the widths of the roll stands define the extension in the direction parallel to the shafts of the rollers in the sense of the present application. In so far, this is relevant, as with increasing diameters of the rollers the roll stand has to be constructed more stable and more massive, which finally comes along with an increase of the width of the roll stand.

In an embodiment of the present invention, the pilger rolling mill comprises a gear rack holder, which is formed in a manner such that the gear rack is adapted to be arranged at the gear rack holder at least at two positions separated from each other in a direction perpendicular to the shafts of the rollers and perpendicular to the direction of motion of the roll stand, wherein each distance between the positions is at least 10 mm. Further, in an embodiment, the distance between the positions is understood as the distance between the position of the gear heads measured in a direction perpendicular to the shafts of the rollers and perpendicular to the direction of motion of the roll stand.

Hence, the gear rack is adjustable at least at two distinct height positions, wherein a single distance of the positions is at least 10 mm, so that rotation axes of the rollers comprise at least two different distances to each other. This makes it possible that two roll stands differing from each other with respect to the roller diameter can be installed in the same pilger rolling mill. In this regard, a drive gear is adjusted to the respective roller diameter on the shaft of the upper or lower roller, preferably the lower roller, while the drive gear can still cog with the gear rack.

In an embodiment, each distance of the positions is at least 20 mm. In an embodiment each distance of the positions is 100 mm at maximum. In a further embodiment, each distance of the positions is 40 mm at maximum.

The drive gear, which is arranged together with one of the two rollers on a shaft, transforms its rotational motion onto the rollers, such that the differently applicable roller diameters each can machine a smaller range of tube diameters with high precision. Thus, the range of diameters range of the finished tubes, which can be manufactured with a single pilger rolling mill, is enlarged without any loss in quality to be expected.

A further embodiment of the present invention is a pilger rolling mill, which comprises two gear rack holders with gear racks fixed thereon. The gear rack holders are arranged mirror symmetrically with respect to a reference plane extending perpendicularly to the shafts of the rollers. Herein, the shaft of one of the two rollers, preferably of the lower roller, carries a drive gear on both sides of the reference plane, wherein both drive gears cog with one of the gear racks each and wherein a cylindrical axis of the hollow, to be located between the rollers, lies within the reference plane.

The arrangement of the gear racks, which are fixed at the gear rack holders and are mirror symmetrically with respect to the reference plane, reduces the existence of torques having a negative influence on the rolling process, since existing torques are compensated due to the mirror symmetrical arrangement. As a result, such a mirror symmetrical arrangement causes a considerably lower wear of the individual components of a pilger rolling mill. This has also an influence on reduced costs for operation and reparations and, therefore, makes the pilger rolling mill more profitable.

In a further embodiment of the present invention, the pilger rolling mill comprises a gear rack holder, which is pivotably mountable away from the roll stand with respect to an axis parallel to the direction of motion of the roll stand, such that a fast exchange of roll stands is enabled.

In this regard, the pivoting motion of the gear rack holder away from the roll stand represents a swinging opening mechanism for the gear rack holder. The swinging opening of the gear rack holder away from the roll stand exposes the roll stand, such that the roll stand is not blocked by the gear rack holder during lifting, e.g. by a crane. Therefore, the roll stand can be taken out freely and easily from the pilger rolling mill in a direction perpendicular to the shafts of the rollers and perpendicular to the direction of motion of the roll stand.

In a further embodiment of the present invention the pilger rolling mill comprises a gear rack holder, which is pivotably mounted with respect to an axis extending parallel to the direction of motion of the roll stand, wherein the gear rack holder can be hydraulically braced in a direction perpendicular to the shafts of the rollers, such that the gear rack holder absorbs the forces acting in a direction parallel to the reference plane during operation of the pilger rolling mill.

By providing a counter pressure or counter force, respectively, also large forces and torques, which occur during the rolling process, can be absorbed by the gear rack. Usage of hydraulic nuts instead of mechanical clamping nuts saves time during mounting and facilitates easy handling.

In an embodiment of the present invention, the gear rack holder of the pilger rolling mill or parts thereof are exchangeable by a another gear rack holder or parts thereof, such that the gear rack is adapted in a way that it can be arranged at the gear rack holder at least at two positions separated from each other in a direction parallel to the shafts of the rollers.

Therefore, the exchangeability of a first gear rack holder with respect to a second gear rack holder at a second position, which is distanced to the position of the first gear rack holder in a direction parallel to the shafts of the rollers, provides that the gear rack holder is adjustable to the width of at least two roll stands with different widths.

In a preferred embodiment, the gear rack holder is formed of two parts and comprises a basic carrier and an adapter plate. In this regard, the basic carrier is arranged pivotably away from the roll stand with respect to an axis parallel to the roll stand's direction of motion. The adapter plate can be installed easily at the basic carrier, such that the gear rack fixed at the gear rack holder can occupy at least two positions separated from each other in a direction parallel to the shafts of the rollers. By such an arrangement of adapter plates of different sizes in a direction parallel to the shafts of the rollers at the basic carrier or by removing these adapter plates from the basic carrier it is possible to easily adjust the gear rack fixed to the gear rack holder with respect to the width and with respect to the position of the shafts of the rollers of at least two roll stands with different width, respectively.

In contrast to the exchange of a complete gear rack holder, there is the further advantage that the possibility of a pivoting motion is not influenced or even compromised by the mere attaching and/or detaching of attachments. Hence, it is not necessary to readjust the axis around which the gear rack holder is pivotably mounted. In an embodiment of the present invention, the pilger rolling mill comprises a roll stand, which is movably mounted in a floating bearing, preferably on a hydraulically liftable slide. Here, the floating bearing is arranged in a way, such that it facilitates the adjustment of the clearance being between the drive gear and the gear rack in a direction perpendicular to the shafts of the rollers and perpendicular to the direction of motion of the roll stand.

It is an advantage of guiding the slides with maintenance free, low-wear floating bearings that these bearings do not require any additional lubrication. Due to this, the engagement of the drive gear into the gear rack can be set very precisely such that signs of wear arising over time can be reduced. Besides savings of material costs, this goes along with cost advantages due to shorter downtimes of the pilger rolling mill, too.

In a further embodiment of the present invention, the pilger rolling mill comprises two rollers arranged vertically one above the other, wherein the shafts of both rollers are connected with each other via two gear wheels cogging with each other in a way that a pivoting motion of one of the two rollers leads to a pivoting motion of the other one of the two rollers in the opposite direction.

In an embodiment of the present invention the shafts of the rollers of the pilger rolling mill comprise at least one bearing each, wherein at least one bearing of one of the two rollers and one bearing of the other one of the two rollers are hydraulically biased against each other.

Such a hydraulic biasing of the bearings of both rollers enables a very precise adjustment of the roller slit. This is reflected positively in the quality of the tubes to be processed, which receive a very uniform shaping during the rolling process due to a precise adjustment of the roller slit. Furthermore, the wear, which the rollers are subjected to during operation due to abrasion, can be reduced by a precise adjustment of the roller slit.

In a further embodiment of the present invention, the stroke length of the roll stand, which is determined by an eccentricity of a crank pin, at which a connecting rod is attached, is adjusted with respect to the largest processable tube diameter and remains unchanged for all processable tube diameters.

The larger the tube diameter to be processed the larger the roller diameter has to be in order to carry out the rolling process with high precision and quality. The increase of the roller diameter comes with an increase of the mass of the roll stand. Accordingly, also the roller force increases. In order to provide for a uniform distribution of force per area unit, the size of the area, on which the rolling is carried out, increases with an increase of the roller force as well. Accordingly, the feed length of a single stroke is larger at larger roller diameters, such that the stroke length of the roll stand is larger, too. As a result, the stroke length of the roll stand is determined by the largest tube diameter to be processed in the pilger rolling mill. For considerably smaller processable tube diameters, however, this stroke length does not represent a compromise. The feed length of a single stroke is considerably smaller for smaller tube diameters to be processed due to the smaller roller diameter chosen, such that, in this case, a larger stroke number becomes relevant in the rolling process. However, this number cannot be arbitrarily high, since the tube processing becomes unprecise and there are more and more wall thickness irregularities above a certain speed of the rolling process, such that a reduction of quality occurs.

In a further embodiment, the stroke length of the roll stand, which is determined by the eccentricity of a crank pin, at which the connecting rod is attached, is adjustable for different processable tube diameters. For the adjustment of the stroke length, the distance between the rotation axis of the fly wheel or the crank drive and the fixing point of the connecting rod on the fly wheel is adjusted, i.e. the eccentricity of the crank pin is modified in a selectable and adjustable manner. Therefore, there is a possibility to adjust the pilger rolling mill for the manufacturing of different types of tubes in a quick and cost efficient manner.

In a further embodiment of the present invention, the crank shaft of the crank drive comprises a co-rotating balance mass, wherein the balance mass is arranged such that it compensates or almost compensates the first order moments applied to the first roll stand, which is incorporated in the pilger rolling mill, wherein the mass of the first roll stand is smaller than the mass of the second roll stand. In this regard, it is advantageous, once this balance mass is displaced by 180° from the crank pin relative to the rotation axis of the crank shaft.

A crank shaft in the sense of the present invention is understood as every type of shaft with a concentrically attached crank pin to receive a connecting rod.

During the rotation of a crank shaft with a connecting rod and without balance mass at the crank drive's crank shaft, so called rotating mass forces occur due to the rotating eccentrical arrangement of the crank pin with respect to the rotation axis, wherein the rotating mass forces become noticeable as shaft vibrations radial to the rotation axis. In order to provide a uniform operation of the roll stand and, therefore, a high quality of the rolled tubes, it is, therefore, necessary to ensure an operation of the crank drive being as steady as possible, such that essentially no free forces and no free moments occur or free forces and free moments are minimized, respectively.

In this regard, it is advantageous to balance these free forces with at least one balance mass co-rotating on the crank drive's crank shaft, as the complete first order moments acting on the crank drive are compensated as good as possible by the balance mass.

The rotating mass forces occurring during operation of the pilger rolling mill can be balanced completely with a balance mass, which is arranged at the crank drive eccentrically displaced to the crank shaft's rotation axis by 180° with respect to the pivot-point of the connecting rod. This balance mass leads to a rotationally symmetric mass distribution of the crank shaft with the connecting rod with respect to the crank shaft's rotation axis and causes a first order mass balance.

In an embodiment, the balance mass is arranged such that it compensates or almost compensates first order moments applied to the first roll stand, which is incorporated in the pilger rolling mill, wherein the mass of the first roll stand is smaller than the mass of the second roll stand.

A second roll stand with larger mass is moved with a smaller angular velocity of the crank shaft in comparison with the first roll stand with a smaller mass. The rotating mass forces increase quadratically with the angular velocity, however, they increase only linearly with the rotating mass. In case of a second roll stand with a large mass, the mass difference between this roll stand and the first roll stand with smaller mass can be balanced at least partially by the respective reduction of angular velocity. This causes that the balance mass, which is dimensioned for the first roll stand, compensates the rotating mass well also for the second roll stand with larger mass.

As an alternative to this embodiment, the balance mass is arranged such that the balance mass compensates as good as possible the moments acting on the crank drive for a roll stand's mass, which is given by the average value of the masses of first and second roll stands.

As a further alternative of this embodiment, the balance mass is attached removably at the crank drive such that it can be adjusted to the mass of the second roll stand, which is incorporated in the pilger rolling mill, as good as possible during the exchange of the first roll stand. This enables a run of the crank drive which is free of free forces or moments or for which the free forces and moments are minimized, respectively.

In an embodiment of the present invention the pilger rolling mill comprises a compensation shaft with a second co-rotating balance mass, wherein the crank drive and the compensation shaft are connected effectively with each other via a central control such that during operation of the cold pilger rolling mill the compensation shaft rotates with double the angular velocity of the crank shaft, and wherein the second balance mass is arranged such that it compensates or almost compensates the second order moments applied the first roll stand, which is incorporated in the pilger rolling mill, wherein the mass of the first roll stand is smaller than the mass of the second roll stand.

Besides the compensation of the free first order mass forces, free second order mass forces occur during operation of a pilger rolling mill with an oscillating linear motion of the roll stand. The free second order mass forces transfer second order moments onto the crank shaft via the connecting rod and influence the uniform run of the crank shaft negatively.

The free second roller mass forces oscillate over time at double angular velocity of the crank shaft. Therefore, the second order mass forces can be minimized or compensated, respectively, with the compensation shaft according to the invention, which is connected effectively to the crank shaft via a central controller and rotates together with a balance mass at double angular velocity of the crank shaft. In this process, the balance mass is adjusted in such a way that it facilitates the best possible compensation of second order moments for the first roll stand, wherein the first roll stand has a smaller mass than the second roll stand.

As described above, a balance mass designed for the first roll stand can well compensate the rotating mass forces also for the second roll stand with a larger mas. Moreover, the second order moments contribute less to the sum of rotating mass forces than the first order moments.

Further advantages, features and applications of the present invention become apparent from the following description of a preferred embodiment and from the accompanying figures.

FIG. 1 shows a schematic cross-sectional side view of a layout of a pilger rolling mill according to an embodiment of the present invention.

Figure 2A:
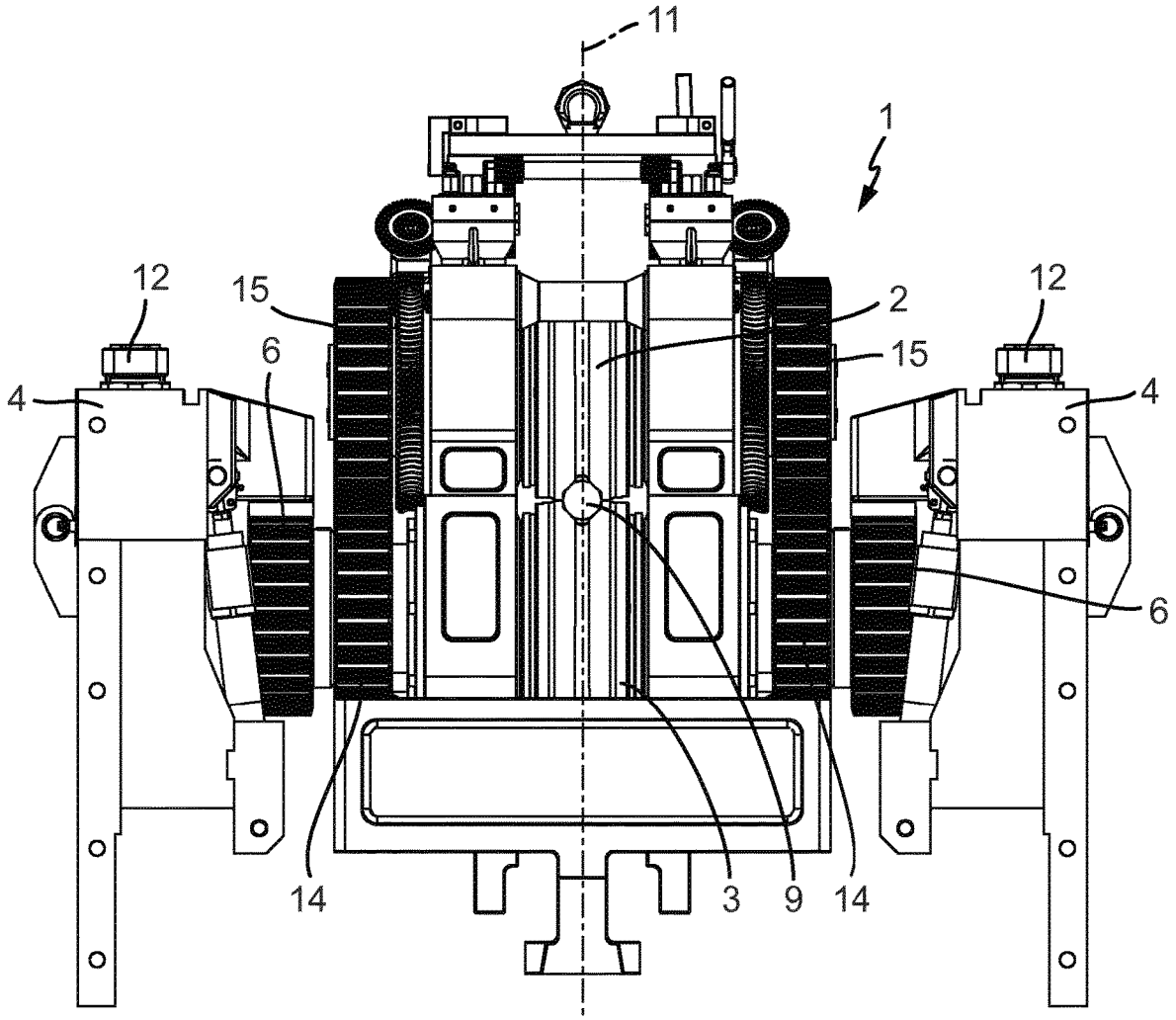

FIG. 2*a* shows a front view of a first roll stand of the pilger rolling mill of FIG. 1.

Figure 2B:
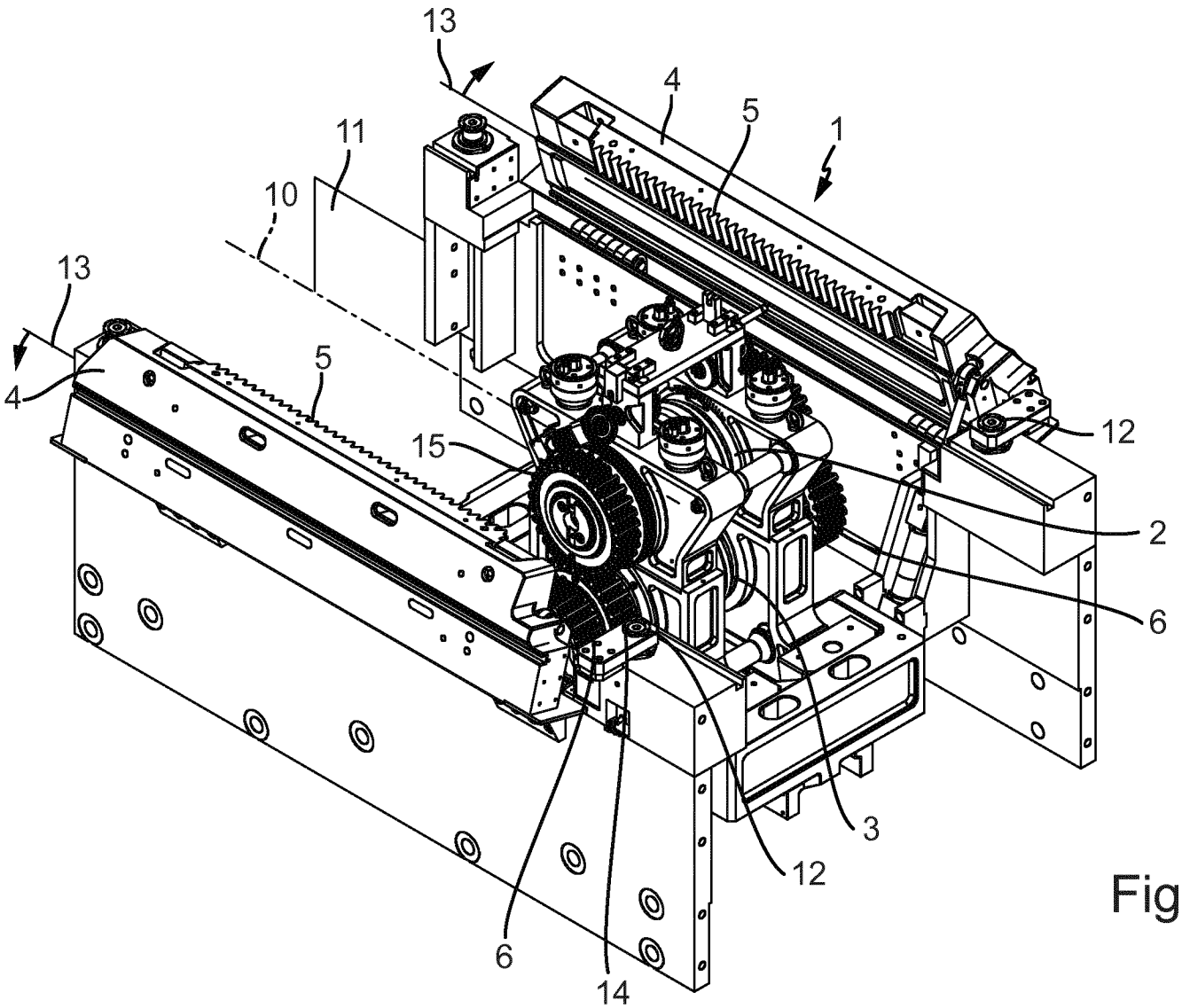

FIG. 2*b* shows a diagonal view from above onto the roll stand of FIG. 2*a* with the gear rack holder in an open position.

Figure 3A:
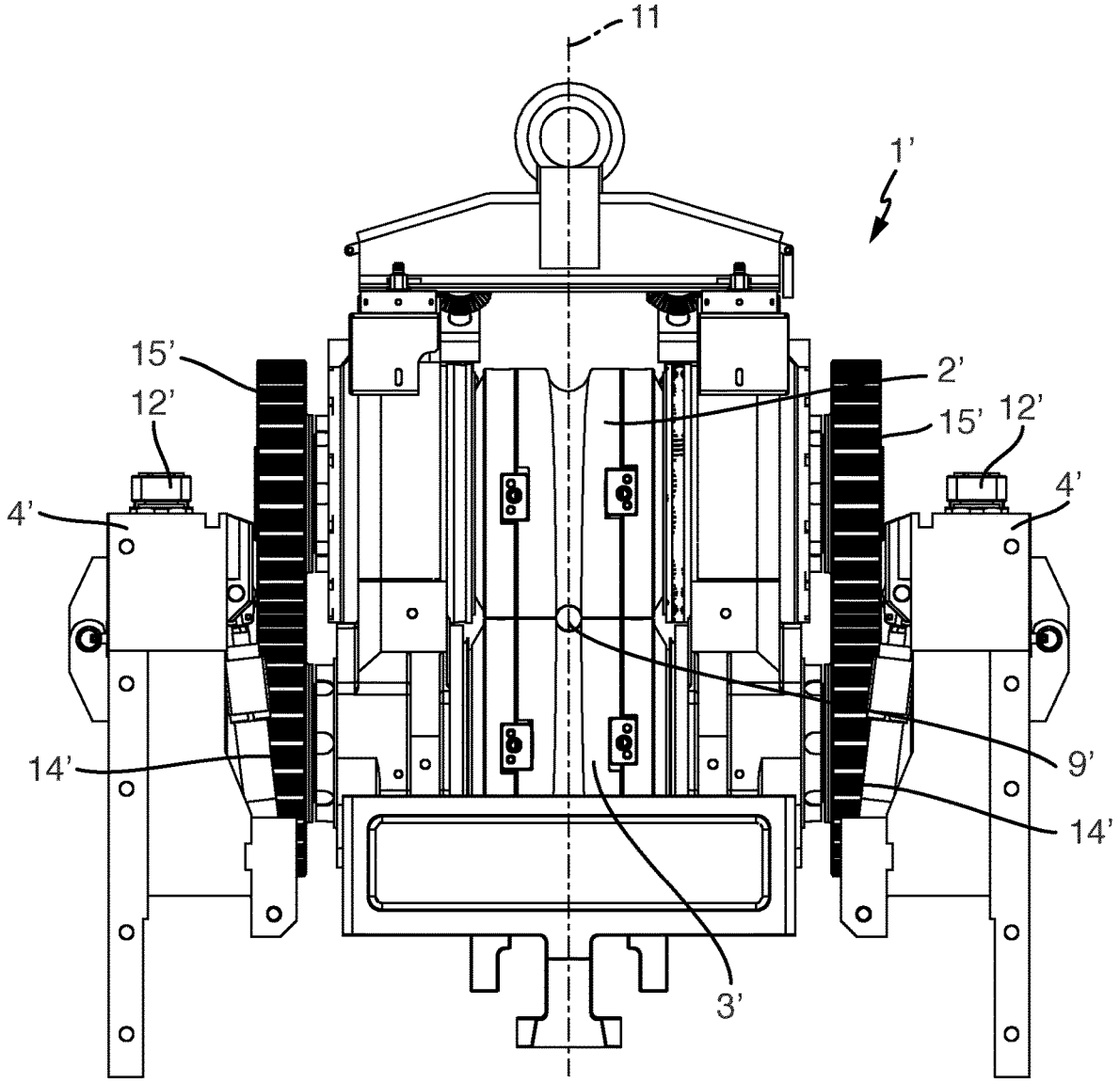

FIG. 3*a* shows a front view of a second roll stand of the pilger rolling mill of FIG. 1.

Figure 3B:
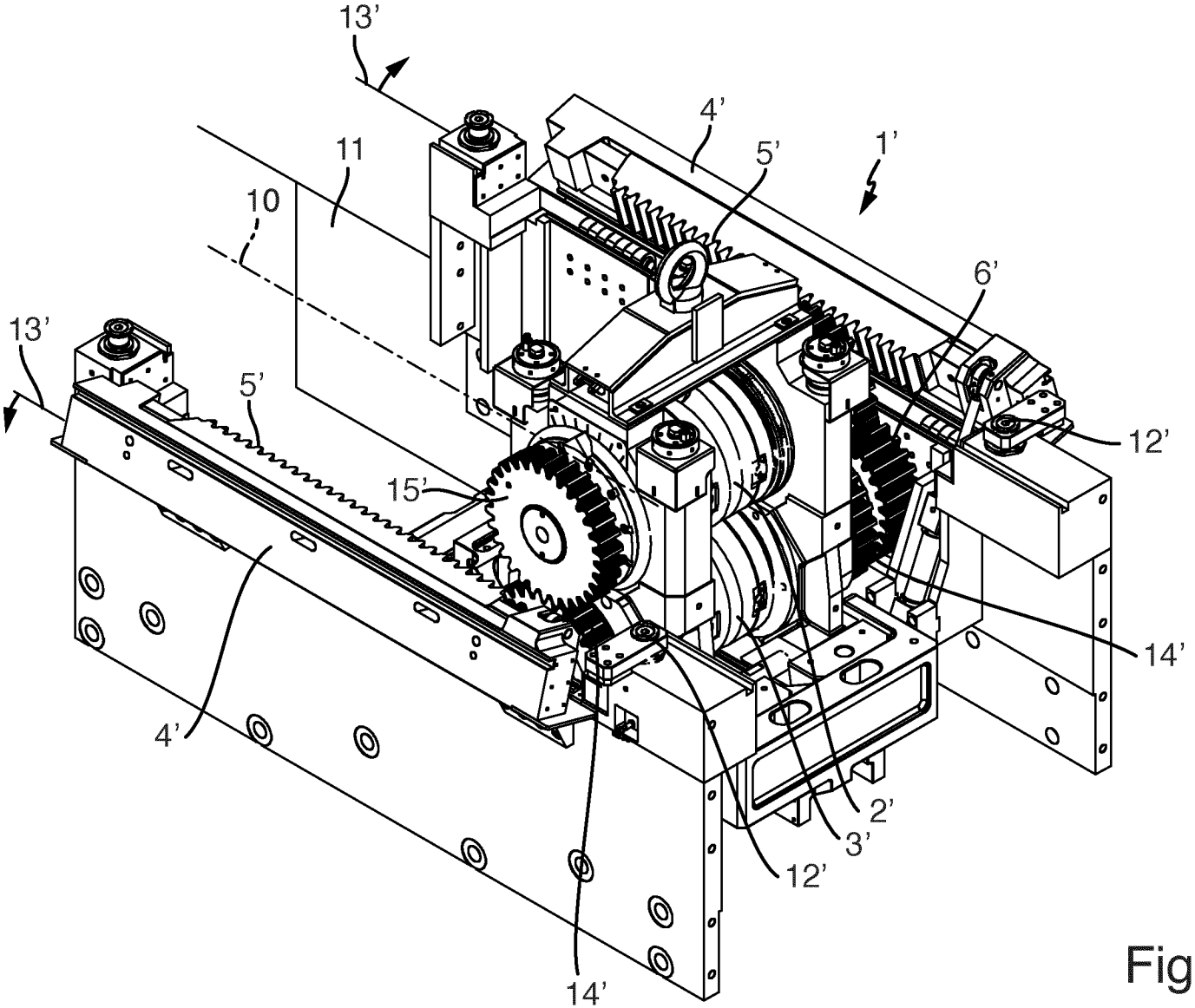

FIG. 3*b* shows a diagonal view from above onto the roll stand of FIG. 3*a* with the gear rack holder in an open position.

In FIG. 1, the layout of a pilger rolling mill according to the invention is shown in a schematic cross-sectional side view, wherein features not essential for the understanding have been omitted. The shown pilger rolling mill comprises a roll stand 1 with rollers 2, 3, two drive gears 6 arranged on the shaft of the lower roller 3, two gear racks 5 each attached to a gear rack holder 4, a calibrated mandrel 7 as well as a feed clamping carriage 8. Here, the drive gears 6 are not visible, since one is hidden by the lower roller 3 and the other has been omitted in this illustration for the sake of clarity. The gear racks 5 as well as the gear rack holders 4 are not shown in FIG. 1 either.

In the shown embodiment, even though not visible in FIG. 1, the pilger rolling mill comprises two gear rack holders 4 being arranged mirror symmetrically with respect to a reference plane, which is perpendicular to the shafts of the rollers. Fixed gear racks 5 are attached to these gear rack holders 4. Here, the gear rack holders 4 are pivotably mounted away from the roll stand 1 with respect to a pivoting axis 13 extending parallel to the direction of motion of the roll stand.

During pilgering at the rolling mill shown in FIG. 1, the hollow 9 is fed stepwise in a direction towards the mandrel 7 or over the mandrel 7, respectively. At the same time, the rotating rollers 2, 3 are moved back and forth horizontally over the mandrel 7 and, hence, over the hollow 9. In this process, the horizontal motion of the rollers 2 and 3 is determined by the roll stand 1, at which the rollers 2, 3 are pivotably mounted. The roll stand 1 is moved back and forth with the crank drive in the direction parallel to the mandrel, while the rollers 2, 3 themselves maintain their rotation due to the gear racks 5 which are fixed relative to the roll stand 1. Drive gears 6, which are rigidly corrected to the lower roller axis, cog with the gear racks 5. In this process, firstly a translational motion of the roll stand 1 is transformed into a rotational motion of the drive gears 6. At the shaft of the lower roller 3, the drive gears 6 are arranged right and left to each gear wheel 14 not shown in FIG. 1, such that the rotational motion of the drive gears 6 causes a rotational motion of the lower gear wheels 14. The lower gear wheels 14 cog with one upper gear wheel 15 of the same diameter each, which are arranged vertically one above the other and are not shown in FIG. 1, wherein the upper gear wheel 15 is arranged on the shaft of the upper roller 2. Due to this, the upper gear wheels 15 are rotated with the same angular velocity as the lower gear wheels 14, but with the opposite direction of rotation when compared with the lower gear wheels 14. Hence, by the gear wheels 14, arranged on the shaft of the lower roll 3, cogging with the gear wheels 15, arranged on the shaft of the upper roller 2, a rotational motion of the rollers 2 and 3 is caused in opposite directions with respect to each other.

Furthermore, each of the shafts of the upper and lower rollers 2, 3 comprises a left and right bearing, wherein the left bearing of the upper roller is hydraulically braced against the left bearing of the lower roller 3 as well as the right bearing of the upper roller 2 is hydraulically braced against the right bearing of the lower roller 3. The hydraulic bracing of the left and right bearings of both rollers 2, 3 against each other facilitates a precise adjustment of the roller slit. As a result, a very uniform shape of the tubes is obtained during rolling.

The feed of the hollow 9 over the mandrel 7 is carried out by the feed clamping carriage 8, which enables a translational motion in a direction parallel to the axis of the mandrel 7. The conically calibrated rollers 2, 3, arranged vertically one above the other in the roll stand 1, roll opposite to the feed direction of the feed clamping carriage 8 on the shell surface of the tube to be processed in a direction parallel to the cylindrical axis of the tube. The so-called pilgrim jaw created by the rollers grips the hollow 9. And the rollers 2, 3 push away a small material wave from the outside, which is stretched to the desired wall thickness by a smoothing caliber of the rollers 2, 3 and of the mandrel 7 until an idling caliber of the rollers 2, 3 releases the finished tube. During rolling, the roll stand 1 with the rollers 2, 3 fixed thereon moves opposite to the feed direction of the hollow 9. By the feed clamping carriage 8, the hollow 9 is pushed forward another step towards the mandrel after reaching the idling caliber of the rollers 2, 3, while the rollers 2, 3 together with the roll stand 1 move back to their horizontal starting position. At the same time, the hollow 9 is rotated with respect to its own axis in order to achieve a uniform shape of the finished tube. By rolling each tube section multiple times, a uniform wall thickness and circularity of the tube as well as uniform inner and outer diameters are achieved.

For a precise adjustment of the clearance between the drive gear 6 and the gear rack 5 in a direction perpendicular to the shafts of the rollers 2, 3 and perpendicular to the roll stand's direction of motion, the roll stand in FIG. 1, even though not noticeable, is mounted movable in a floating bearing, which here is formed a hydraulically liftable slide. The hydraulic bearing, besides the possibility of precise adjustments between drive gear 6 and gear rack 5, is distinguished by the possibility of easy assembly, which particularly simplifies and speeds-up the exchange of the roll stand 1. As a consequence, the downtimes related to an exchange of a roll stand can be reduced considerably. Furthermore such a bearing of the rollers 2, 3 does not require wear intensive seals and pistons. That means that the hydraulic bearing is essentially maintenance free and free of wear.

The stroke length of the pilger rolling mill shown in FIG. 1 is uniform for all processable tube diameters and is determined by the largest tube diameter to be processed in the pilger rolling mill.

This facilitates a simplified operating procedure, since no elaborated change of the crank pin 21 is required. Rather, the crank pin 21 stays the same for all processing steps.

In an alternative embodiment, it would be possible to design the stroke length of a pilger rolling mill adjustable for different processable tube diameters. For this, the distance between the rotation axis of the fly wheel of the crank drive and the fixing point of the connecting rod on the fly wheel is adjusted accordingly. This means that the crank pin 21 is modified. Consequently, the stroke length can be adjusted optimally with respect to the tube diameter to be processed, such that the different processable tube diameters can be manufactured with a better precision when compared to a stroke length staying the same for different processable tube diameters. For this, however, the elaborate change of the crank pin 21 has to be accepted.

In the shown embodiment, further, a central controller 20 is provided, which is connected to the drive of the compensation shaft 17 as well as to the drive of the crank shaft. The controller 20 controls the drives in a way that their drive shafts rotate in the same direction, wherein the rotational frequency of the compensation shaft 17 is double the rotational frequency of the crank shaft.

Furthermore, the controller 20 guarantees an angularly synchronous rotation of both balance masses 16, 18 of crank shaft and compensation shaft 17. This means that both balance masses 16, 18 are positioned at the same angle after one revolution of the crank drive, wherein the balance mass 18 of the compensation shaft 17 performs two revolutions within the time interval in which the crank shaft performs a single revolution.

In FIG. 2*a*, a front view of the roll stand of the pilger rolling mill of FIG. 1 is shown. The roll stand 1 with a mass $M_1$ is arranged for the processing of hollows with a diameter between 30 mm and 60 mm. The maximum stroke number of the roll stand, i.e. the maximum number of forth and back motions of the roll stand per time unit, is 200 per minute for the present embodiment shown in FIG. 2*a*. Since the productivity of a cold pilger rolling mill directly depends on the stroke number of the roll stand, a number of strokes per minute as large as possible is desired due to economic reasons.

The roll stand 1 in FIG. 2 comprises an arrangement of rollers 2, 3 and drive gears 6 being mirror symmetrically with respect to a reference plane 11, which is perpendicular to the shafts of the rollers 2, 3, wherein a cylindrical axis of the hollow 9, to be received between the rollers 2, 3, lies within the reference plane 11. Here, the drive gears 6 are rigidly connected with the shaft of the lower roller 3 and cog with the gear racks 5, which are also arranged mirror symmetrically at the gear rack holders 4. The gear racks 5 are not shown in FIG. 2*a*, since they are hidden by the gear rack holder 4.

In order to absorb the forces acting in a direction parallel to the reference plane 11 during operation of the pilger rolling mill, the gear rack holders 4 are hydraulically braced in a direction perpendicular to the shafts of the rollers. The hydraulic biasing is conducted by a system of hydraulic nuts 12, which essentially consist of a ring piston and a cylinder. By a temporary pressure impact, a force is set up in a direction perpendicular to the shafts of the rollers. Due to this, temporary clamping and sliding forces can be set up, such that the roll stand 1 is held in a fixed position during the rolling process in a direction parallel to the shafts of the rollers 2, 3. Hence, the roll stand is prevented from sliding away due to torsional forces occurring.

Furthermore, the gear rack holder 4 shown in FIG. 2*a* is mounted pivotably away from the roll stand with respect to a pivot-axis 13 extending parallel to the gear rack 5. The pivot-axis is not shown in FIG. 2*a* due to its orientation into the image plane. By an easy raising of the gear rack holder 4 away from the roll stand, the drive gears 6 lose their contact to the gear racks 5, such that the roll stand 1 is not blocked by the gear rack holder 4 during lifting by a crane. Therefore, the roll stand 1 can be exchanged freely and in an easy and quick manner. This goes along with a larger flexibility of the processing steps with respect to the expandable range of processable tube diameters.

FIG. 2*b* shows a diagonal view from above onto the roll stand of FIG. 2*a* but with the gear rack holder 4 in an open position, wherein that the gear rack holder 4 has been pivoted with respect to its pivot-axis 13 away from the roll stand in the direction denoted by the arrow. As a result, the gear rack 5, which is attached to the gear rack holder 4, has no contact with the drive gear 6 any longer. Hence, the roll stand 1 is not blocked by the gear rack holder 4 any longer and can be removed from the pilger rolling mill by lifting in an easy and quick manner and can be exchanged by a second roll stand 1' with different dimensions.

FIG. 3*a* shows a front view of a second roll stand 1' of the pilger rolling mill of FIG. 1. In contrast to FIG. 2*a*, the roll stand 1' has larger dimensions with respect to the three spatial dimensions as well as with respect to the diameter of the rollers 2', 3' and drive gears 6', but the roll stand 1' can be installed into the same pilger rolling mill as shown in FIG. 1. The larger dimensions of the roll stand 1' shown in FIG. 3*a* are reflected in an increased mass when compared to the roll stand 1 of FIGS. 2*a* and 2*b*. In the present embodiment, the mass of the second roll stand is 2.5 times the mass $M_1$ of the roll stand 1 of FIGS. 2*a* and 2*b*. Furthermore, the roll stand 1' shown in FIG. 3*a* is arranged for the processing of hollows with a diameter between 40 mm and 88 mm and, hence, for lager diameters when compared to the roll stand 1 of FIGS. 2*a* and 2*b*. The maximum stroke number of the roll stand 1' is 150 per minute, which is a correspondingly lower value in this regard.

The gear rack holder 4' according to the invention is located at a position further away from the reference plane 11' in a direction perpendicular to the reference plane 11' when compared with the gear rack holder 4 shown in FIG. 2*a*. In the embodiments shown in FIGS. 2*a* and 3*a*, this is enabled by a two-part design of the gear rack holders 4, 4'. On the one hand, the gear rack holder comprises a basic carrier, and on the other hand, an adapter plate, which is attachable to the basic carrier in a way that the respective drive gear 6, 6' of the roll stand 1, 1' can cog with the gear rack 5, 5' attached to the respective gear rack holder 4, 4' at least at two positions separated from each other in a direction perpendicular to the reference plane 11. In case of FIG. 2*a*, this adapter plate is constructed larger in a direction parallel to the shafts of the rollers 2, 3 than in case of FIG. 3*a*, such that the gear rack 5 comprises a smaller distance from the reference plane 11 in the direction of the normal of the reference plane 11.

Besides the position parallel to the shafts of the rollers 2', 3', however, also an adjustment of the gear rack holder 4' is necessary in the direction perpendicular to the shafts of the rollers 2', 3' and perpendicular to the roll stand's 1' direction of motion. The required adjustment is caused by the larger diameter of the drive gear 6' when compared to the drive gear 6 shown in FIG. 2*a*. Such an adjustment is realized by the two-part gear rack holder 4' in terms of a basic carrier with adapter plates attached thereon and designed accordingly, such that the drive gear 6' of the roll stand 1' can cog with the gear rack 5', which is attached to the gear rack holder 4'.

FIG. 3*b* shows a diagonal view from above onto the roll stand 1' of FIG. 3*a*. In this case, the gear rack holder 4' is pivoted away from the roll stand 1' with respect to the pivot-axis 13' extending parallel to the roll stand's direction of motion. The gear rack holder 4' is arranged in an open position like in FIG. 2*b* in such a way that the gear rack 5' attached to the gear rack holder 4' does not have any contact to the drive gear 6' of the roll stand 1'. Even for an embodiment of a roll stand 1' with larger dimensions compared to the dimensions shown in FIGS. 2*a* and 2*b*, the roll stand 1' can be removed from the pilger rolling mill in an easy and quick manner with the pivot-mechanism exposing the roll stand 1'.

For the purpose of original disclosure it is noted that all features, which a person skilled in the art derives from the present description, the figures and the claims, even though they are not concretely described in connection with certain further features, can be combined both as individual features as well as in arbitrary combinations with other features of the here disclosed features and groups of features as far as this is not explicitly ruled out or there are technical reasons that such combinations are not possible or nonsense. Only for the sake of the description's shortness and readability, an explicit and comprehensively description of all possible feature combinations has been omitted.

While the invention has been illustrated and described in detail in the figures and in the above description, this illustration and description is only by way of an example and is not meant to be a limitation of the scope of protection, which is defined by the claims. The invention is not limited to the disclosed embodiments.

Changes of the disclosed embodiments are obvious to a person skilled in the art on the basis of the figures and description and the attached claims. In the claims, the word "comprise" does not exclude other elements or steps, and the definite article "a" or "an" does not exclude a plural. The pure fact that certain features are claimed by separate claims does not exclude their combination. Reference numbers in the claims are not meant to be limiting to the scope of protection.

LIST OF REFERENCE NUMERALS

1, 1' roll stand
2, 2', upper roller
3, 3' lower roller
4, 4' gear rack holder
5, 5' gear rack
6, 6' drive gear
7 calibrated mandrel
8 feed clamping carriage
9, 9' hollow
10 cylinder axis of the hollow
11, 11' reference plane
12, 12' hydraulic nut
13, 13' pivot-axis of the gear rack holder
14, 14' lower gear wheel
15, 15' upper gear wheel
16 balance mass
17 compensation shaft
18 second balance mass
19 connecting rod
20 central controller
21 crank pin

The invention claimed is:

1. A pilger rolling mill for working a hollow into a tube comprising:

a first roll stand mounted linearly movable in a direction of motion, wherein two rollers are pivotably mounted on shafts on the roll stand for working the hollow into the tube, wherein, on one of the shafts, one of the rollers is arranged with a drive gear and wherein the drive gear engages in a fixed gear rack, and wherein the gear rack is attached to a gear rack holder such that a translational motion of the roll stand causes a rotational motion of the drive gear and the roller; and a crank drive connected to the roll stand, wherein the crank drive transforms a rotational motion of a motor drive by a connecting rod into an oscillating translational motion of the roll stand during operation of the pilger rolling mill, wherein the gear rack holder is arranged in a way that the first roll stand with a first dimension is exchangeable by a second roll stand with a second dimension being different from the first dimension, and wherein the gear rack holder is arranged in a way that the gear rack is attachable at the gear rack holder at least at two positions that are separated from each other in a direction parallel to the shafts of the rollers.

2. The pilger rolling mill according to claim 1, wherein the gear rack holder is arranged in a way that the gear rack is attachable at the gear rack holder at least at two positions being separated from each other in a direction perpendicular to the shafts of the rollers and perpendicular to the direction of motion of the roll stand, and wherein a distance between these positions measured in a direction perpendicular to the shafts of the rollers and perpendicular to the direction of motion of roll stand is at least 10 mm.

3. The pilger rolling mill according to claim 1, wherein the gear rack holder is a first gear rack holder, the gear rack is a first gear rack, and the drive gear is a first drive gear, wherein the pilger rolling mill further comprises a second gear rack attached to a second gear rack holder, wherein the first and second gear rack holders have a mirror symmetrical arrangement with respect to a reference plane that is perpendicular to the shafts of the two rollers, wherein a second drive gear is arranged on the one shaft with the first drive gear, wherein each of the first and second drive gears engage with a respective one of the first and second gear racks, and wherein a cylindrical axis of the hollow receivable between the rollers, lies within the reference plane.

4. A pilger rolling mill for working a hollow into a tube comprising:

a first roll stand mounted linearly movable in a direction of motion, wherein two rollers are pivotably mounted on shafts on the roll stand for working the hollow into the tube, wherein one of the rollers is arranged on a shaft with a drive gear and wherein the drive gear engages in a fixed gear rack, and wherein the gear rack is attached to a gear rack holder such that a translational motion of the roll stand causes a rotational motion of the drive gear and the roller; and a crank drive connected to the roll stand, wherein the crank drive transforms a rotational motion of a motor drive by a connecting rod into an oscillating translational motion of the roll stand during operation of the pilger rolling mill, wherein the gear rack holder is arranged in a way that the first roll stand with a first dimension is exchangeable by a second roll stand with a second dimension being different from the first dimension, and wherein the gear rack holder is mounted pivotably away from the roll stand with respect to an axis being parallel to the direction of motion of the roll stand.

5. A pilger rolling mill for working a hollow into a tube comprising:

a first roll stand mounted linearly movable in a direction of motion, wherein two rollers are pivotably mounted on shafts on the roll stand for working the hollow into the tube, wherein one of the rollers is arranged on a shaft with a drive gear and wherein the drive gear engages in a fixed gear rack, and wherein the gear rack is attached to a gear rack holder such that a translational motion of the roll stand causes a rotational motion of the drive gear and the roller; and a crank drive connected to the roll stand, wherein the crank drive transforms a rotational motion of a motor drive by a connecting rod into an oscillating translational motion of the roll stand during operation of the pilger rolling mill, wherein the gear rack holder is arranged in a way that the first roll stand with a first dimension is exchangeable by a second roll stand with a second dimension being different from the first dimension, wherein the gear rack holder is pivotably mounted with respect to an axis being parallel to the direction of motion of the roll stand, and wherein the gear rack holder is hydraulically bracable in a direction perpendicular to the shafts of the rollers, such that the gear rack holder absorbs forces acting in a direction parallel to a reference plane that is perpendicular to the shafts of the two rollers during operation of the pilger rolling mill.

6. The pilger rolling mill according to claim 1, wherein the gear rack holder is a first gear rack holder and the first gear rack holder or parts thereof is exchangeable by a second gear rack holder or parts thereof, such that the gear rack is attachable to either the first gear rack holder or the second gear rack holder at least at two positions being separated from each other in the direction parallel to the shafts of the rollers.

7. The pilger rolling mill according to claim 1, wherein the roll stand is movably mounted in a floating bearing, and wherein the floating bearing is arranged in a way that it facilitates an adjustment of the clearance between the drive gear and the gear rack in a direction perpendicular to the shafts of the rollers and perpendicular to the direction of motion of the roll stand.

8. The pilger rolling mill according to claim 1, wherein the rollers are arranged one above the other, and wherein the shafts of both rollers are connected by two gear wheels engaging with each other in a way that a rotational motion of one of the two rollers leads to a rotational motion of the other one of the rollers in the opposite direction.

9. The pilger rolling mill according to claim 1, wherein the shafts of the rollers comprise at least one bearing each, and wherein at least one bearing of one of the two rollers and one bearing of the other one of the two rollers are hydraulically braced against each other.

10. The pilger rolling mill according to claim 1, wherein a stroke length of the roll stand, which is determined by the eccentricity of a crankshaft pin being attached at the connecting rod, is set for the largest processable tube diameter and remains the same for all processable tube diameters.

11. The pilger rolling mill according to claim 1, wherein a stroke length of the roll stand, which is determined by the eccentricity of a crankshaft pin being attached to the connecting rod, is adjustable for different processable tube diameters.

12. The pilger rolling mill according to claim 1, wherein a crank shaft of the crank drive comprises a co-rotating balance mass, wherein the balance mass is arranged in a way that it compensates or almost compensates first order moments conducted by the first roll stand, which is placed in the pilger rolling mill, and wherein a mass of the first roll stand is smaller than a mass of the second roll stand.

13. The pilger rolling mill according to claim 1, wherein the pilger rolling mill comprises a compensation shaft with a co-rotating balance mass, wherein a crank shaft and the compensation shaft are effectively connected in a way that the compensation shaft rotates at double angular velocity of the crank shaft during operation of the pilger rolling mill, wherein the balance mass is arranged in a way that it compensates or almost compensates first order moments conducted by the first roll stand, which is placed in the pilger rolling mill, and wherein a mass of the first roll stand is smaller than a mass of the second roll stand.

14. The pilger rolling mill according to claim 1, wherein a crank shaft of the crank drive comprises a first co-rotating balance mass, wherein the pilger rolling mill comprises a compensation shaft with a second co-rotating balance mass, wherein the crank shaft and the compensation shaft are effectively connected in a way that the compensation shaft rotates at double angular velocity of the crank shaft during operation of the pilger rolling mill, wherein the first co-rotating balance mass and the second co-rotating balance mass is arranged are each arranged in a way to compensate or almost compensate first order moments conducted by the first roll stand, which is placed in the pilger rolling mill, and wherein a mass of the first roll stand is smaller than a mass of the second roll stand.

15. The pilger rolling mill according to claim 1, wherein the shaft of the lower roller carries the drive gear.

16. The pilger rolling mill according to claim 6, wherein the first gear rack holder and the second gear rack holder are each adjustable to the width of at least two roll stands with different widths.

17. The pilger rolling mill according to claim 1, wherein the roll stand is movably mounted in a floating bearing in a hydraulically liftable slide, and wherein the floating bearing is arranged in a way that it facilitates an adjustment of the clearance between the drive gear and the gear rack in a direction perpendicular to the shafts of the rollers and perpendicular to the direction of motion of the roll stand.

18. The pilger rolling mill according to claim 1, wherein the gear rack holder is mounted pivotably away from the roll stand with respect to an axis being parallel to the direction of motion of the roll stand.

19. The pilger rolling mill according to claim 1, wherein the gear rack holder is pivotably mounted with respect to an axis being parallel to the direction of motion of the roll stand, and wherein the gear rack holder is hydraulically bracable in a direction perpendicular to the shafts of the rollers, such that the gear rack holder absorbs forces acting in a direction parallel to a reference plane that is perpendicular to the shafts of the two rollers during operation of the pilger rolling mill.

20. A pilger rolling mill for working a hollow into a tube comprising:

a first roll stand mounted linearly movable in a direction of motion, wherein two rollers are pivotably mounted on shafts on the roll stand for working the hollow into the tube, wherein one of the rollers is arranged on a shaft with a drive gear and wherein the drive gear engages in a fixed gear rack, and wherein the gear rack is attached to a gear rack holder such that a translational motion of the roll stand causes a rotational motion of the drive gear and the roller; and a crank drive connected to the roll stand, wherein the crank drive transforms a rotational motion of a motor drive by a connecting rod into an oscillating translational motion of the roll stand during operation of the pilger rolling mill, wherein the gear rack holder is arranged in a way that the first roll stand with a first dimension is exchangeable by a second roll stand with a second dimension being different from the first dimension, and wherein the gear rack holder is arranged in a way that the gear rack is attachable at the gear rack holder at least at two positions that are separated from each other in a direction parallel to an axial direction of axes of the shafts of the two rollers.

* * * * *